US009145689B2

(12) United States Patent
Deumer

(10) Patent No.: US 9,145,689 B2
(45) Date of Patent: Sep. 29, 2015

(54) FASTENING SYSTEM

(75) Inventor: Patrick Deumer, Steinfort (LU)

(73) Assignee: Vetedy S.á.r.l, Steinfort (LU)

( * ) Notice: Subject to any disclaimer, the term of this patent is extended or adjusted under 35 U.S.C. 154(b) by 0 days.

(21) Appl. No.: 14/131,190

(22) PCT Filed: Jul. 6, 2012

(86) PCT No.: PCT/EP2012/063290

§ 371 (c)(1),
(2), (4) Date: Feb. 25, 2014

(87) PCT Pub. No.: WO2013/004821

PCT Pub. Date: Jan. 10, 2013

(65) Prior Publication Data

US 2014/0161516 A1 Jun. 12, 2014

Related U.S. Application Data

(60) Provisional application No. 61/511,935, filed on Jul. 26, 2011.

(30) Foreign Application Priority Data

Jul. 6, 2011 (LU) ..... 91835

(51) Int. Cl.

| | |
|---|---|
| ***F16B 17/00*** | (2006.01) |
| ***E04F 13/08*** | (2006.01) |
| ***E04F 15/02*** | (2006.01) |

(52) U.S. Cl.

CPC ..... *E04F 13/0801* (2013.01); *E04F 13/081* (2013.01); *E04F 13/0816* (2013.01); (Continued)

(58) Field of Classification Search

CPC . Y10T 403/70; E04E 13/0801; E04E 13/081; E04E 13/0816; E04E 13/0823; E04E 15/02044; E04E 2015/02072

USPC ..... 403/345, 353–355; 52/36.6, 506.01, 52/506.05, 511; 211/94.01; 248/220.21, 248/220.22, 223.41, 224.8, 225.11

See application file for complete search history.

(56) References Cited

U.S. PATENT DOCUMENTS 2,739,456 A * 3/1956 Saunders ..... 62/288
4,272,139 A * 6/1981 Fler ..... 312/334.11

(Continued)

FOREIGN PATENT DOCUMENTS

| | | |
|---|---|---|
| EP | 0272658 A2 | 6/1988 |
| FR | 1407947 A | 8/1965 |
| GB | 2414029 A | 11/2005 |

OTHER PUBLICATIONS

International Search Report and Written Opinion mailed Nov. 2, 2012, for corresponding International Application No. PCT/EP2012/063290, 10 pages.

*Primary Examiner* — Gregory Binda
*Assistant Examiner* — Nahid Amiri
(74) *Attorney, Agent, or Firm* — Seed IP Law Group PLLC

(57) ABSTRACT

An arrangement is provided for fastening an element on a support surface. The arrangement includes a rail having a lower face, an upper face and a protruding part having a C-profile, the lower face coming into contact with the support surface; a substantially rectangular mounting part having a base plate which defines a lower face and an upper face, the upper face including an anchor; and an element (e.g., siding strip) to be fastened. The element has a lower face including at least one recess arranged to engage with the anchor of the mounting part. The C-profile is open on the upper-face side and defines a profile width and a profile height, and the C-profile is configured to slideably receive the mounting part therein. The rail comprises a toothed surface extending on its upper-face. The mounting part includes at least one stop on the upper face of the base plate.

14 Claims, 7 Drawing Sheets

(52) U.S. Cl.
CPC ..... *E04F13/0823* (2013.01); *E04F 15/02044* (2013.01); *E04F 2015/02072* (2013.01); *Y10T 29/4995* (2015.01); *Y10T 403/70* (2015.01)

(56) References Cited

U.S. PATENT DOCUMENTS 4,607,753 A * 8/1986 Radek ..... 211/94.01
6,311,955 B1 * 11/2001 McGarry et al. ..... 256/24
6,315,257 B1 * 11/2001 Fennesz ..... 248/232
6,763,957 B1 * 7/2004 Mullerleile ..... 211/94.01
7,114,789 B2 * 10/2006 Keaton ..... 312/132
7,257,925 B2 * 8/2007 Manogue et al. ..... 52/29
7,624,554 B2 * 12/2009 Chae ..... 52/480
8,070,378 B2 * 12/2011 Gargaro et al. ..... 403/381
8,276,343 B2 * 10/2012 Yang ..... 52/584.1
2006/0156664 A1 7/2006 Chae
2009/0019795 A1 * 1/2009 Szacsvay et al. ..... 52/173.3
2011/0073155 A1 * 3/2011 Sillmann et al. ..... 136/244
2011/0174353 A1 * 7/2011 Urban et al. ..... 136/244

* cited by examiner

FASTENING SYSTEM

TECHNICAL FIELD

The present invention relates to an arrangement for fastening visible elements and in particular an arrangement for mounting sidings in any material.

BACKGROUND OF THE INVENTION

The present invention belongs to the field of fastening visible elements on planar surfaces. External flat roofs or facades are commonly made from boards, for example wooden strips, installed on a framework which in particular is made up of wall plates previously fastened to the floor or to the wall.

At present there are wooden siding systems, known as tongue and groove systems, without open joints between the siding strips. Systems of this type propose a method involving wall plates fastened on watertight insulation (generally a rubber-like web) on which the siding boards are fastened by nailing into tongues provided for this purpose. The adjacent board fits into the tongue via a groove specially profiled for this purpose. As the sidings are insufficiently ventilated, rot usually begins to set in and damages the support structure of the siding.

Other systems for invisible fastening with open joints have similar problems. Improved ventilation of the sidings is ensured by the open joints between the siding boards. Nevertheless, the fastenings are made from profiled grooves on the sides of the boards, which causes rainwater to collect, promoting rot and the proliferation of algae and insects on the structure. The wood may also buckle since, owing to capillary action, the finishing board touches the siding which is full of the moisture which enters the wood. This causes the hygrometry on the lower face of the finishing board to increase in relation to the upper face, which causes the surface wooden strips to sag and become less aesthetically pleasing.

The object of the present invention is to remedy at least some of the negative aspects present in the prior art.

SUMMARY OF THE INVENTION

According to a first aspect of the present invention, an arrangement is proposed for fastening an element on a support surface.

The arrangement comprises at least one rail comprising a lower face, an upper face and a protruding part. The lower face contacts the support surface. The arrangement further comprises at least one substantially rectangular mounting part comprising a base plate, which has a lower face and an upper face, the upper face comprising anchoring means. Furthermore, the arrangement comprises at least one element to be fastened, such as a siding board, or siding strip. The element has a lower face comprising at least one recess. The recess is arranged so as to engage with the anchoring means of a mounting part.

The at least one rail comprises a C-profile which is open on the upper-face side. The profile defines a profile width and a profile height. The C-profile is adapted to receive a mounting part. The rail further comprises a toothed surface extending on its upper-face.

The base plate of the mounting part has a width, which corresponds substantially to the profile width of the rail and a thickness, which corresponds substantially to the profile height of the rail. This makes it possible to slide the mounting part along the profile and to hold the mounting part. The base plate further comprises, on its lower face, a structure with at least one tooth, so as to cooperate with said toothed surface when the mounting part is held by the rail.

According to a further aspect of the present invention, there is provided a rail device for fastening an element on a support surface. The rail has a lower face and an upper face, the lower face coming into contact with the support surface. The rail comprises a C-profile which is open on the upper-face side. The profile defines a profile width and a profile height. The C-profile is adapted to receive an adapted mounting part. The rail further comprises a toothed surface extending on its upper-face.

According to another aspect of the present invention, there is provided a mounting part device. The mounting part has a substantially rectangular shape. The mounting part comprises a base plate having a lower face and an upper face. The upper face comprises anchoring means adapted to fasten the element to be fastened. The base plate of the mounting part has a width that corresponds substantially to a profile width of a rail, and a thickness that corresponds substantially to the profile height of an adapted rail, making it possible to slide the mounting part along said profile and to hold the mounting part in an adapted rail. The base plate further comprises, on its lower face, a structure with at least one tooth, so as to cooperate with said toothed surface when the mounting part is held by said adapted rail.

According to yet another aspect of the present invention, there is provided an element to be fastened, for use as a siding element, the element having a lower face provided with at least one recess. The at least one recess is adapted to cooperate with the anchoring means of an adapted mounting part Preferably, the anchoring means of the mounting part may comprise at least one foot, which may be substantially perpendicular to the base plate. The foot may be equipped on one face with at least one tenon, said tenon projecting at right angles to the foot. The tenon may preferably be dimensioned so as to cooperate with a counterpart profile groove in a wall of the recess of the element to be fastened.

The foot of the mounting part and the recess of the element to be fixed may advantageously be dimensioned so that at least a part of the lower face (111) of the element to be fixed rests on the upper surface (128) of the rail (120), when said foot is engaged in said recess (112).

Preferably, the anchoring means and the grooved recess may be configured in such a way that the element to be fastened may be attached to the mounting part by a first movement by engaging the foot in the recess without the tenon penetrating the groove, and in such a way that the element may then be displaced in a direction perpendicular to the first movement to engage the tenon in the groove.

The tenon may preferably be arranged in the upper part of the foot.

The mounting part may preferably comprise at least one stop on the upper face of the base plate. The at least one stop may be situated on the side opposite the side of the foot carrying the tenon. The stop may preferably be replaceable.

It is preferred that the mounting part may comprise a tongue at one of its ends, and at the opposite end a recess suitable for receiving the tongue of an adjacent mounting part.

The mounting part may preferably be moulded in a single piece from a plastics or composite material.

The rail may preferably comprise a tongue at one of its ends, and at the opposite end a recess suitable for receiving the tongue of an adjacent rail.

The rail may preferably be moulded in a single piece from a plastics or composite material.

The rail and/or the mounting part may be produced by extrusion of a plastics or composite material.

The element to be fastened may preferably be a siding strip having a lower face provided with at least one longitudinal trench with a groove dimensioned so as to cooperate with at least one tenon of an adapted mounting part. The siding strip may be made of wood.

According to yet another aspect of the present invention, there is provided a facade arrangement comprising siding strips fastened to a vertical support, further comprising rails and mounting parts according to any one of the preceding claims, for fastening said siding strips.

According to a further aspect of the present invention, there is provided a method for fastening an element to a surface, the method being based on a device comprising rails and mounting parts as defined above. The method comprises the following steps:

fastening a rail on a support;

sliding a mounting part into the rail;

installing the element on the mounting part by engaging the foot of the mounting part in the recess of the element, and displacing the element towards the tenon on said foot so as to push said tenon into said counterpart groove in a wall of said recess.

Another similar mounting part may preferably be slid onto the rail to support another adjacent element, this other mounting part being positioned such that the stop thereof prevents a displacement of the first element along the rail's axis.

Preferably, another similar rail element may be fastened to the support so as to extend the first rail.

The elements to be fastened may preferably be siding boards or siding strips having a lower face provided with at least one longitudinal trench, the at least one trench presenting a groove dimensioned so as to cooperate with at least one tenon of an adapted mounting part.

The arrangement according to the present invention also makes it possible to mount sidings quickly and precisely on horizontal or vertical surfaces, and in particular on facades. The system makes it possible to install sidings with invisible fastenings and uses a minimum of screws. Since the siding boards are not in contact with other wooden elements, and since ventilation of the boards is ensured, the longevity thereof is ensured.

BRIEF DESCRIPTION OF THE DRAWINGS

The invention will be described with reference to examples, which will be illustrated by the figures. The figures do not limit the scope of the invention.

DESCRIPTION OF THE INVENTION

Figure 1:
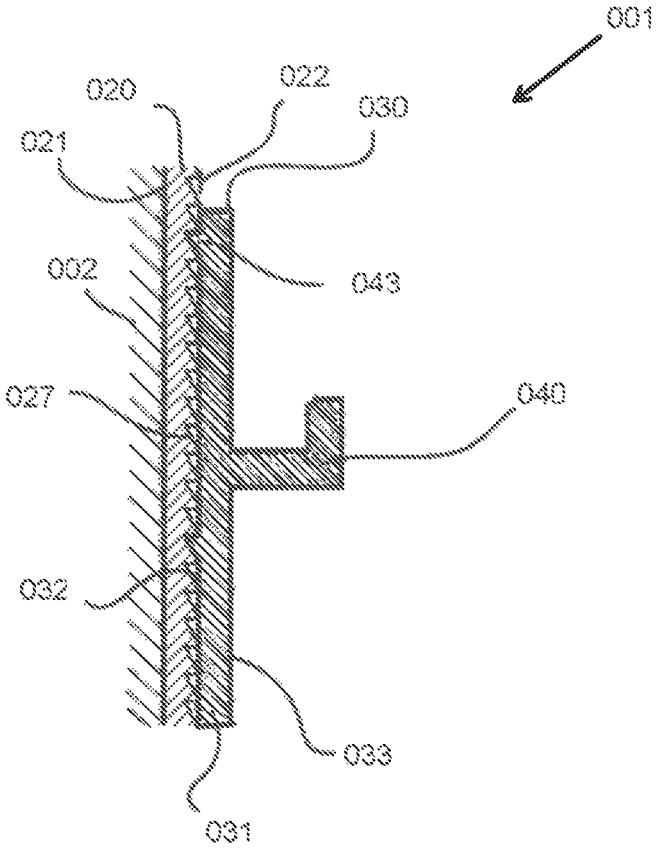
FIG. 1 is a schematic lateral section of a device according to the present invention in a preferred configuration.

The invention will be described below by way of an advantageous embodiment and with reference to the accompanying drawings. In the drawings, similar numerals represent similar concepts in different embodiments of the invention. For example, the fastening arrangement according to the present invention is denoted by numerals 001, 101, 201.

Figure 2:
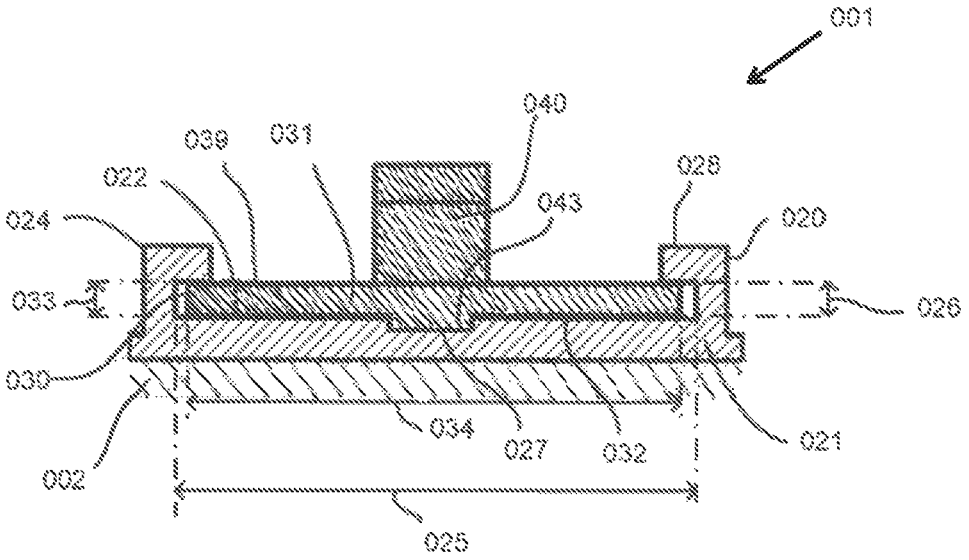
FIG. 2 is a schematic view from above of a device according to the present invention in a preferred configuration.

With reference to FIG. 1 and FIG. 2, the arrangement 001 according to the present invention comprises at least one fastening rail element 020 having a C-profile 024. The lower face 021 of the rail advantageously contacts a support 002. The rail 020 is preferably fastened to the support 002 by screwing. The support 002 corresponds for example to a wall to be covered with a siding. The rail element 020 is typically orientated vertically on the support. As shown in FIG. 2, the C-profile has an opening which is orientated towards the upper face 022 of the rail and defines a profile width 025 and a profile height 026.

The arrangement 001 also comprises at least one mounting part 030. The mounting part 030 is rectangular in shape and is used to interconnect the at least one rail, which is fastened to the support 002, and the element to be fastened. The part 030 comprises a base plate 031 having a thickness 033 and a width 034. The thickness 033 advantageously corresponds substantially to the profile height 026 of the rail 020. Similarly, it is advantageous for the width 033 to correspond substantially to the profile width 025 of the rail 020. This makes it possible for the mounting part 030 to slide in the rail profile 020. Indeed, no separate mechanical connection means such as a screw or a nail is necessary for fastening the mounting part to the rail. This allows rapid construction of the basic framework which will be able to hold the elements to be fastened, such as siding strips made of wood, metal or composite material.

The arrangement 001 is preferably used for fastening a siding on a vertical wall. Other uses, for example installing flooring strips or installing ceiling strips on a horizontal support, will be obvious to the person skilled in the art. It is preferred that the at least one element to be fastened extends in a direction that is perpendicular to the direction in which the at least one rail extends. Typically, a siding strip is supported by multiple rails, each of the rails being fitted with at least one mounting part.

The upper surface 039 of the mounting part comprises at least one anchoring means 040. The anchoring means 040 is arranged such that it can receive an element to be fastened, for example a siding strip. The anchoring means 040 preferably engages with a counterpart structure on the lower face of the element to be fastened, which lower face is not visible after mounting, and which is directed towards the mounting part.

The anchoring means are preferably dimensioned such that an element to be fastened which is engaged with said anchoring means 040 rests on the surface 028 of the C-profile of the rail 020, the surface being defined by the protruding part of the rail, as shown in FIG. 2.

In order to improve the way a mounting part is held and fastened on the rail 020, it is advantageous to provide at least one toothed surface 027, which extends on the upper surface 022 of the rail 020.

In that case, the mounting part 030 has at least one structure with at least one counterpart tooth or slot 043 on its lower face 032. This structure with at least one tooth 043 engages with the at least one toothed surface 027 of the rail 020 and makes it possible to slide the mounting part 030 incrementally along the rail 300. This makes it possible to position the mounting part on the rail in a precise and reproducible manner.

Figure 3A:
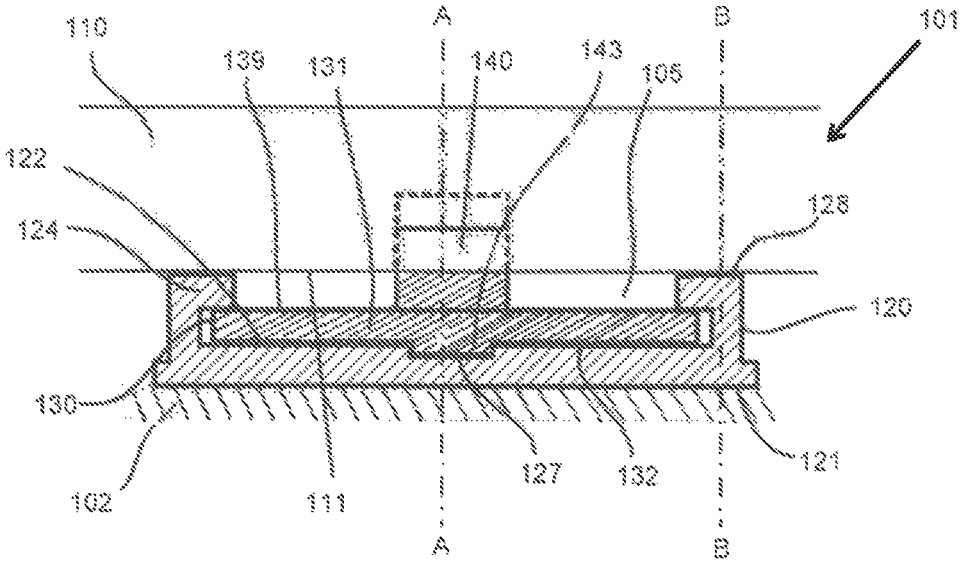
FIG. 3*a* is a schematic view from above of a device according to the present invention in a preferred configuration.

FIG. 3*a* shows the structures shown in FIG. 2, but FIG. 3*a* also shows an element that is to be fixed 110, such as a siding strip. The lower face 111 of the element to be fixed rests at least partly on an upper surface 128 of the C-profile of the rail 120. By this arrangement, a ventilation space 105 is created between the upper surface 139 of the mounting part and the lower surface 111 of the element to be fixed. The ventilation space 105 makes sure that the device is sufficiently aerated, thereby increasing the lifespan of the device.

The element to be fixed 110 is held securely as it is tightly pulled against the rail 120. The anchoring means 140 of the mounting part pull the element to be fixed tightly towards the rail surface 128.

Figure 3B:
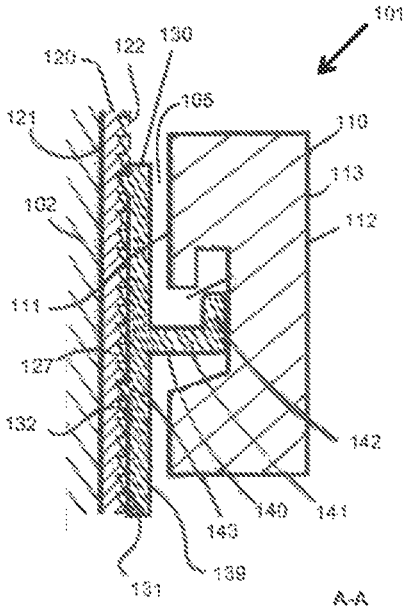
FIGS. 3*b*, 3*c*, 3*d* and 3*e* show a schematic lateral section of a device according to the present invention in a preferred configuration, including an element to be fastened.
Figure 3C:
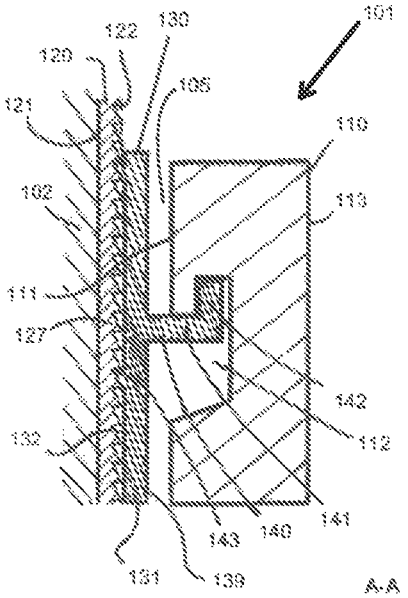
Figure 3D:
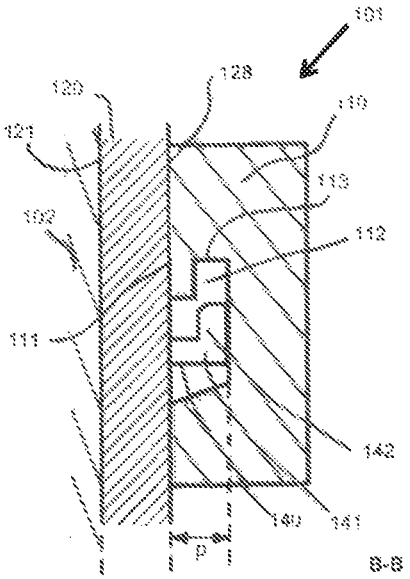
Figure 3E:
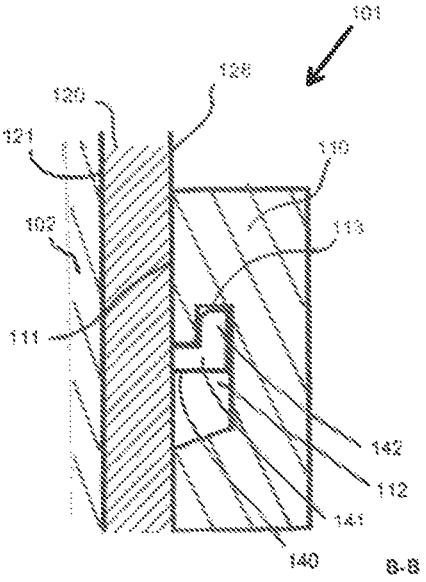

With reference to FIGS. 3*b* and 3*c*, the anchoring means 140 of the mounting part advantageously comprises at least one projecting foot 141 which is orientated perpendicular to the base plate 131. In a preferred embodiment, a pair of feet or a plurality of pairs of feet 141 are arranged on the surface 131. These anchoring means make it possible to receive the element to be fastened 110. The length of the at least one projecting foot 141 is such that the foot engages with a recess 112 in the lower face of the element to be fixed, while at the same time pulling the element 110 towards the rail, as indicated in FIG. 3*d* and FIG. 3*e*. As shown in FIG. 3*d*, it is particularly advantageous to dimension the foot 141 such that its length exceeds the surface 128 of the rail 120 by a length p when the mounting part is fitted onto the rail. The length p is roughly equal to the depth of the recess 112. This dimensioning allows the element to be fastened securely to the rail. Indeed the mounting part is able to pull the lower face 111 of the element 110 tightly against the surface 128 of the rail 120. Ideally the length p is smaller than the depth of the recess by less than a millimeter.

Each of the feet 141 is preferably equipped with a tenon 142 which extends perpendicularly to the foot on a side of the foot. The tenon 142 is preferably dimensioned so as to cooperate with a counterpart profile groove 113 in a wall of a trench or longitudinal recess 112 of the element to be fastened 110.

The tenons 142 of all the feet 141 are preferably orientated on the same side of their respective feet. This preferred configuration makes it possible to mount a siding strip 110 on an associated mounting part 130 in a simple manner. This is shown in FIG. 3*b* and 3*d* in A-A and B-B cuts respectively. First, the strip 110 to be fastened is placed on the mounting part 130 in such a way that the feet 141 and tenons 142 penetrate the at least one recess 112. Then the strip 110 is displaced so as to engage the tenons 142 in their respective grooves 113, as illustrated in FIGS. 3*c* and 3*e*. In the case of a siding strip fastened on a vertical support, the displacement in question is carried out downwards, which makes it possible for the siding element to be held securely on the mounting part.

Each trench 112 of the part to be fastened preferably has an opening which is slightly larger than that of the feet equipped with tenons in order to facilitate the introduction of said feet into the respective trenches.

Figure 4:
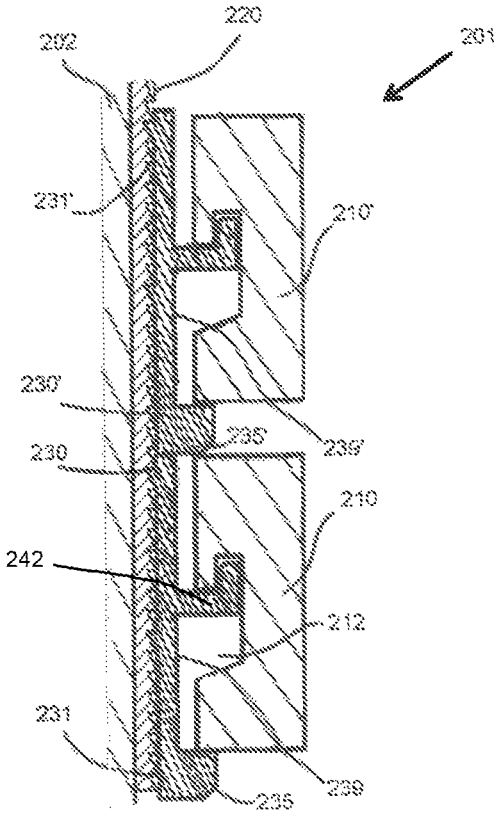
FIG. 4 is a schematic lateral section of a device according to the present invention in another preferred configuration.

A preferred mounting part is illustrated in FIG. 4. The mounting part 230, which is used to interconnect the support rail 220 and the element to be fastened 210, advantageously comprises at least one stop 235 which projects from the upper face 239 of the base plate 231 and is arranged at the end of the plate opposite the tenons 242. The position of the at least one stop 235 is selected such that, when the strip 210 is displaced for fitting together the grooves and tenons, the strip comes into contact with the stop. This stop is preferably positioned at the edge of the mounting part 230, since said stop then makes it possible, during assembly of the siding, to define a bracing dimension in relation to an adjacent siding strip 210'.

After mounting the mounting part and installing the siding strip in the position shown, the act of fastening the subsequent mounting part 230' (above the mounting part 230) causes the siding strip 210 to be locked. In fact, the stop 235' of the second mounting part is placed against the siding strip 210, preventing any displacement in the direction allowing the release of the siding strip. The stop 235, 235' thus has a dual function of locking and bracing adjacent strips.

The elimination of the at least one stop 225', for example by milling, releases the lower siding strip 210, which can then be displaced upwards again to be removed. After positioning a new siding strip on the mounting part, it is possible to fasten, for example by gluing at the site of the initial stop 235', a spacer of the same size to lock the siding strip again.

Figure 5:
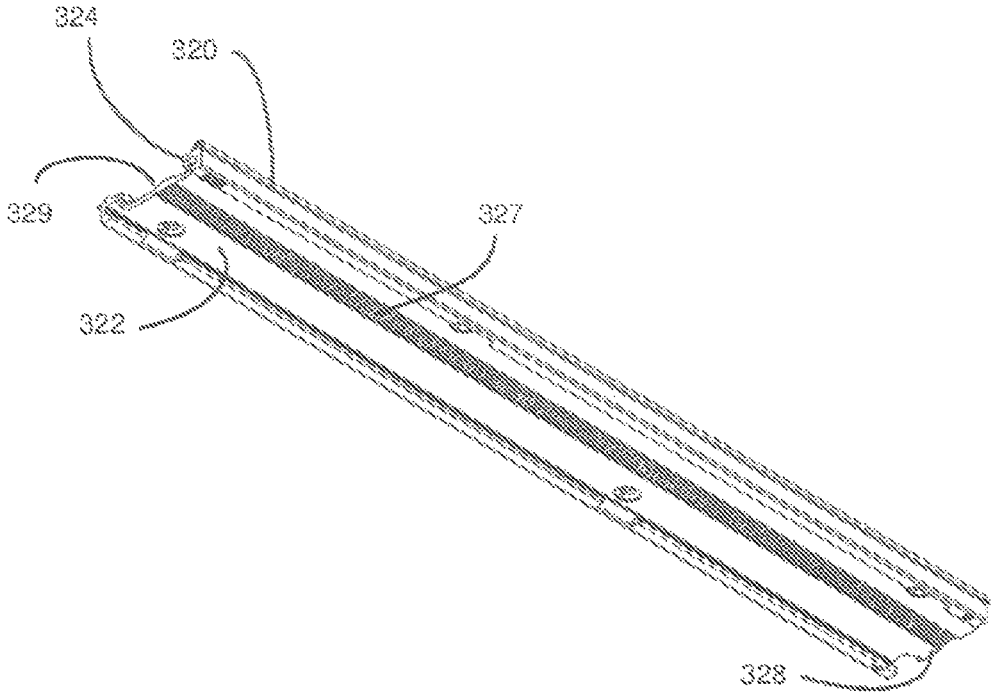
FIG. 5 is a perspective view of a preferred rail according to the present invention.
Figure 6:
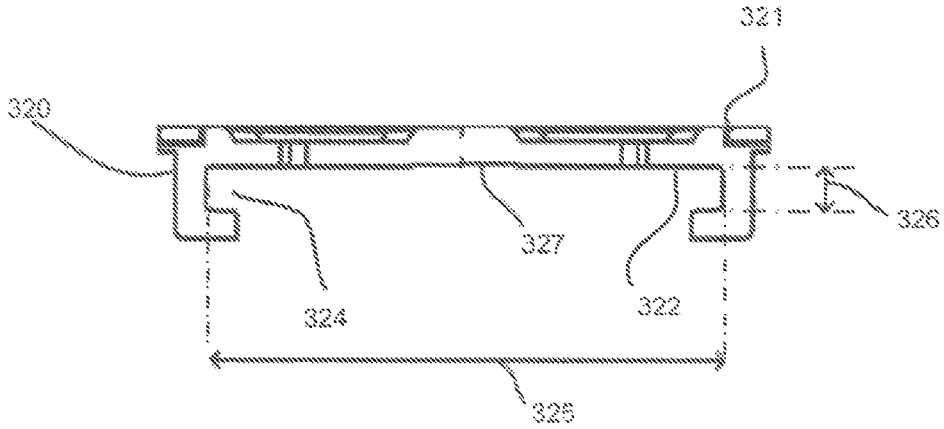
FIG. 6 is a cross-section of a preferred rail according to the present invention.
Figure 7:
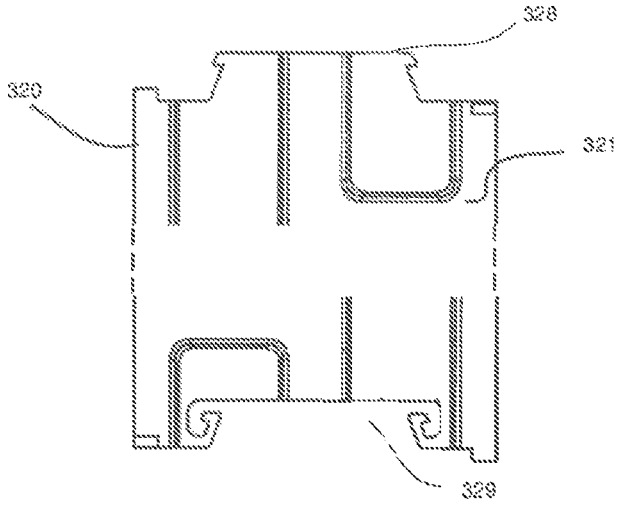
FIG. 7 is a view from below of the ends of a preferred rail according to the present invention.

FIG. 5, FIG. 6 and FIG. 7 show a particularly preferred rail element 320 according to the present invention. To facilitate the alignment of the rail elements during installation, the rail element 320 is advantageously provided at one of its ends with a tongue 328, and at the opposite end with a recess 329 for receiving the tongue of an adjacent rail element. The rail elements are thus fastened side by side on their support by inserting the tongue of a rail into the recess of an adjacent rail. This makes it possible to install a rail comprising a plurality of elements rapidly in a straight line.

Figure 8:
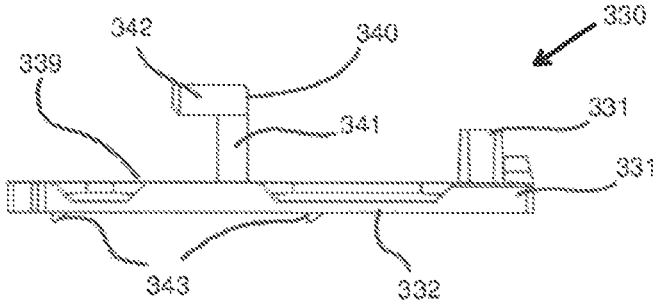
FIG. 8 is a side view of a preferred configuration of a mounting part according to the present invention.
Figure 9:
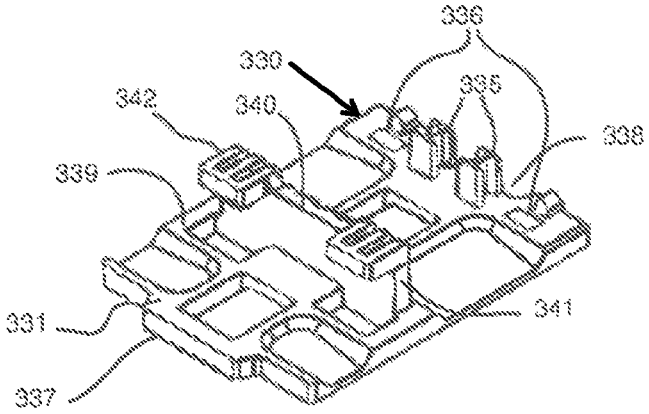
FIG. 9 is a perspective view of a preferred configuration of a mounting part according to the present invention.

FIGS. 8 and 9 show preferred embodiments of a mounting part 330.

To facilitate the alignment of the mounting parts 330 during installation, the base plate 331 is advantageously provided at one of its ends with a tongue 337, and at the opposite end with a recess 338 for receiving the tongue of an adjacent mounting part.

The preferred base plate 331 is advantageously produced so as to have a central reinforcement rib with a predefined thickness, and thinned zones preferably defining downward slopes from the central rib to the edges for facilitating the evacuation of the water held in these parts.

Figure 10A:
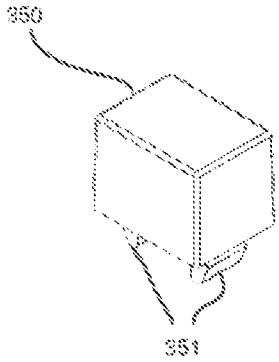
FIGS. 10*a* and 10*b* are a perspective view and a side view of an insert that can replace the stop of a mounting part according to the present invention.
Figure 10B:
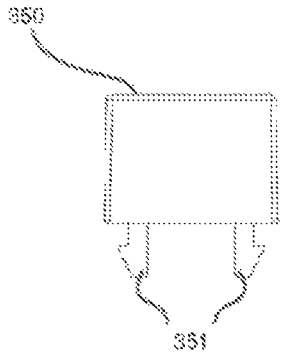

The preferred mounting part 330 advantageously comprises at least one recess 336 for fastening an insert, which acts as the replacement stop. An insert 350 of this type, shown in FIG. 10, comprises fastening means 351 for engaging it in the corresponding recess 336. In this way, it is possible to replace a siding strip and to fasten a spare strip without gluing. This makes it possible to replace siding strips easily without removing the adjacent strips.

Figure 11:
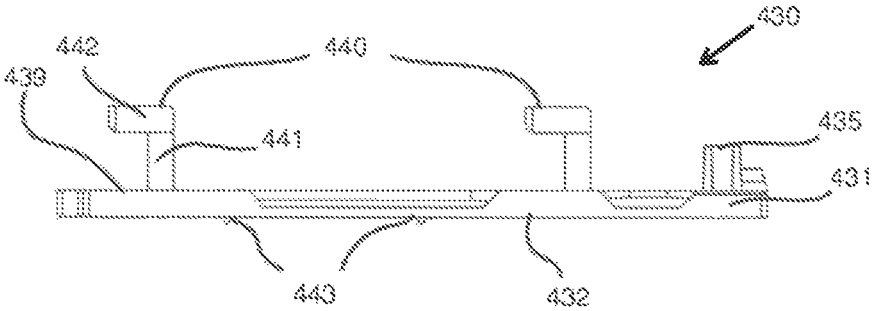
FIG. 11 is a side view of another preferred configuration of a mounting part according to the present invention.
Figure 12:
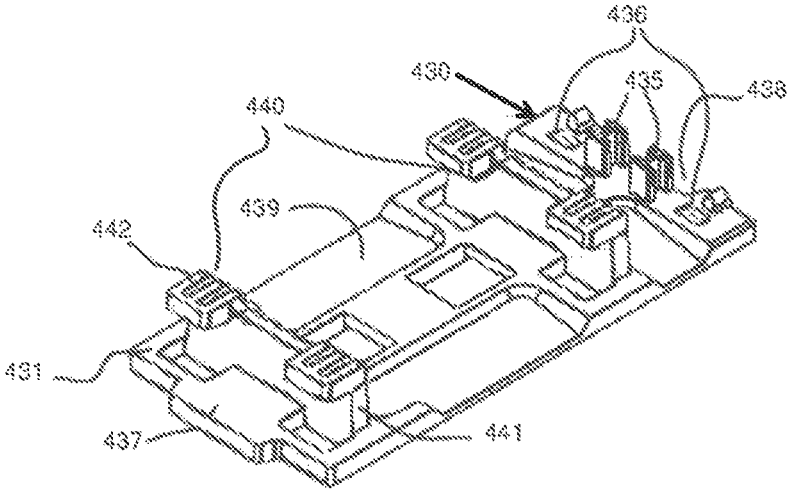
FIG. 12 is a perspective view of another preferred configuration of a mounting part according to the present invention.
Figure 13:
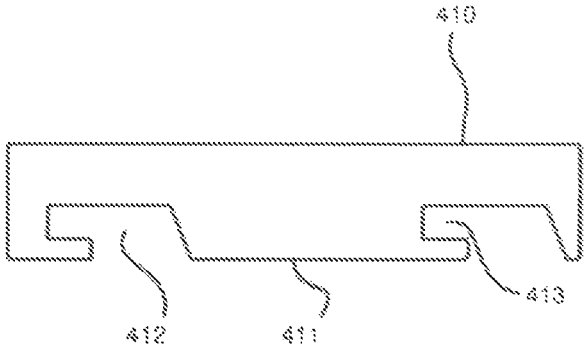
FIG. 13 is a cross-section of a preferred configuration of an element to be fastened using the device according to the present invention.

FIGS. 11 and 12 show an alternative embodiment of a mounting part 430, according to the above-described principle. The anchoring means 440 comprise two pairs of feet 441 equipped with tenons 442 and spaced apart on the upper face 439 of the base plate 431. The siding strip 410 shown in section in FIG. 13 has on its lower face 411, in accordance with the mounting part 430, two trenches 412, 413 which are arranged so as to be able to engage with the two respective pairs of tenons 442.

The rail element and/or the mounting part forming part of the arrangement according to the present invention are advantageously produced by injecting plastics or composite material into moulds produced for this purpose. A polyamide PA is preferably used, advantageously with a reinforcing filler of glass fibres. Other applicable reinforcing fillers are known in the prior art.

A preferred production method for the rail element and the mounting part forming part of the arrangement according to the present invention involves extrusion of a plastics or composite material. To this end, an extrusion head corresponding to the rail profile is produced.

The use of polymeric materials has the advantage of better behaviour of the material with respect to diverse meteorological conditions such as heat or rain. In contrast to wooden frameworks on which most current sidings are fastened, polymeric materials are not deformed, or are only slightly deformed, under the influence of heat or cold. Similarly, compared to wood, these materials eliminate the risks of infiltration due to moisture, at the same time ensuring the durability of the siding.

The arrangement according to the present invention also makes it possible to mount sidings quickly and precisely on horizontal or vertical surfaces, and in particular on facades. In the case of wooden siding boards, these are not in contact with other wooden elements, and as ventilation of the boards is ensured, the longevity thereof is ensured. The fastening elements are invisible after installation.

Typically a siding is completed by using several rails, each arranged in parallel to each other on a surface. It is preferred that the at least one siding strip extends in perpendicular to the extension direction of the rails. The rails' axis are typically spaced by 60 cm. The width of a rail is typically 6 cm. As described, the arrangement according to the present invention allows the ventilation of the siding strips on a large part of a rail's surface, which improves the longevity of the siding.

The present explanation does not limit the scope of protection for the present invention, which will emerge from the following claims.

The invention claimed is:

1. An arrangement comprising:

at least one rail comprising a lower face, an upper face and a protruding part, the lower face coming into contact with a support surface;

at least one substantially rectangular mounting part comprising a base plate which defines a lower face and an upper face, the upper face comprising an anchor;

at least one element to be fastened, the element having a lower face, which comprises at least one recess, the recess being arranged so as to engage with the anchor of the mounting part;

wherein the protruding part of the rail comprises a C-profile which is open on the upper-face side and defines a profile width and a profile height, the C-profile being configured to receive the mounting part, and wherein the rail comprises a toothed surface extending on said upper-face;

wherein the base plate of the mounting part has a width which corresponds substantially to the profile width of the rail, and a thickness which corresponds substantially to the profile height of the rail, making it possible to slide the mounting part along the C-profile and to hold the mounting part in the rail;

wherein the base plate comprises, on its lower face, a structure comprising at least one tooth, said at least one tooth cooperating with said toothed surface when the mounting part is held by the rail;

wherein the mounting part comprises at least one stop on the upper face of the base plate, the at least one stop being situated at an edge of the base plate; and wherein, when the element is mounted on the anchor, a part of the element that is disposed between the anchor and the at least one stop contacts the at least one stop.

2. The arrangement according to claim 1, wherein the anchor of the mounting part comprises at least one foot which is substantially perpendicular to the base plate, the foot being equipped on one face with at least one tenon which projects at right angles to the foot, said tenon being dimensioned so as to cooperate with a counterpart profile groove in a wall of the recess of the element to be fastened.

3. The arrangement according to claim 2, wherein the foot of the mounting part and the recess of the element to be fixed are dimensioned so that at least a part of the lower face of the element to be fixed rests on the upper surface of the rail, when said foot is engaged in said recess.

4. The arrangement according to claim 3, wherein the anchor and the grooved recess are configured in such a way that the element to be fastened is attachable to the mounting part by a first movement, said first movement engaging the foot in the recess without the tenon penetrating the groove, and in such a way that the element may then be displaced in a direction perpendicular to the first movement to engage the tenon in the groove.

5. The arrangement according to claim 3, wherein the tenon is arranged in an upper part of the foot.

6. The arrangement according to claim 1, wherein the stop is replaceable.

7. The arrangement according to claim 1, wherein the mounting part comprises a tongue at one of its ends, and at the opposite end a recess suitable for receiving the tongue of an adjacent mounting part.

8. The arrangement according to claim 1, wherein the mounting part is molded in a single piece from one of a plastics material and a composite material.

9. The arrangement according to claim 1, wherein the rail comprises a tongue at one of its ends, and at the opposite end a recess suitable for receiving the tongue of an adjacent rail.

10. The arrangement according to claim 1, wherein the rail is molded in a single piece from one of a plastics material and a composite material.

11. The arrangement according to claim 1, wherein one or both of the rail and the mounting part is/are produced by extrusion of one of a plastics material and a composite material.

12. The arrangement according to claim 1, wherein the element to be fastened is a siding strip having a lower face provided with at least one longitudinal trench, the trench having a groove in one of its walls, the groove being dimensioned so as to cooperate with at least one tenon of the mounting part.

13. The arrangement according to claim 12, wherein the siding strip is made of wood.

14. A rail assembly comprising:

a rail comprising:

a lower face and an upper face, the lower face coming into contact with a support surface, a C-profile which is open on the upper-face side and defines a profile width and a profile height, the C-profile being configured to receive an adapted mounting part, and a toothed surface extending on its upper-face;

an element to be fastened; and a mounting part having a substantially rectangular shape, the mounting part comprising a base plate which defines a lower face and an upper face, the upper face comprising an anchor configured to fasten the element to be fastened, the upper face further comprising at least one stop situated at an edge of the base plate;

wherein the base plate of the mounting part has a width which corresponds substantially to the profile width of the rail, and a thickness which corresponds substantially to the profile height of the rail, making it possible to slide the mounting part along a profile of the rail and to hold the mounting part in the rail;

and wherein the base plate of the mounting part comprises, on its lower face, a structure with at least one tooth, so as to cooperate with the toothed surface of the rail when the mounting part is held by said rail; and wherein, when the element is mounted on the anchor, a part of the element that is disposed between the anchor and the at least one stop contacts the at least one stop.

* * * * *